US005936195A

United States Patent [19]

Wheatley

[11] Patent Number: 5,936,195

[45] Date of Patent: Aug. 10, 1999

[54] GAS GENERATING COMPOSITION WITH EXPLODED ALUMINUM POWDER

[75] Inventor: Brian K. Wheatley, Marshall, Va.

[73] Assignee: Atlantic Research Corporation, Gainvesville, Va.

[21] Appl. No.: 08/872,320

[22] Filed: Jun. 10, 1997

[51] Int. Cl.[6] ..... C06B 45/10

[52] U.S. Cl. ..... 149/19.91; 149/19.1; 149/46; 149/114; 149/43

[58] Field of Search ..... 149/19.1, 19.91, 149/46, 43, 114

[56] References Cited

U.S. PATENT DOCUMENTS

| | | | |
|---|---|---|---|
| Re. 25,695 | 12/1964 | Cook et al. . | |
| 2,589,532 | 6/1952 | Byers . | |
| 2,935,394 | 5/1960 | Hiler | 149/114 |
| 3,185,601 | 5/1965 | Newman et al. | 149/114 |
| 3,580,753 | 5/1971 | Griffith . | |
| 3,664,897 | 5/1972 | Wakazono et al. . | |
| 3,986,908 | 10/1976 | Grébent et al. | 149/19.7 |
| 3,996,078 | 12/1976 | Klunsch et al. . | |
| 4,089,715 | 5/1978 | Scherzinger . | |
| 4,302,258 | 11/1981 | Fukuma et al. . | |
| 4,948,438 | 8/1990 | Patrick et al. . | |
| 5,451,277 | 9/1995 | Katzakian et al. . | |
| 5,507,891 | 4/1996 | Zeigler | 149/47 |
| 5,544,687 | 8/1996 | Barnes et al. | 149/83 |
| 5,545,272 | 8/1996 | Poole et al. | 149/48 |
| 5,551,729 | 9/1996 | Ludwig | 280/737 |
| 5,641,938 | 6/1997 | Holland et al. | 149/48 |

OTHER PUBLICATIONS

Gennady V. Ivanov and Frederick Tepper, "Activated Aluminum as a Stored Energy Source for Propellants", Presented at the Fourth International Symposium, Stockholm, Sweden, May 27–28, 1996.

*Primary Examiner*—Edward A. Miller
*Attorney, Agent, or Firm*—Sixbey, Friedman Leedom & Ferguson; Frank P. Presta; Joseph S. Presta

[57] ABSTRACT

A gas generating composition, particularly for inflating devices such as air bag inflators, includes an effective amount of an exploded aluminum powder to both increase the burning rate and lower the composition's pressure exponent.

7 Claims, 1 Drawing Sheet

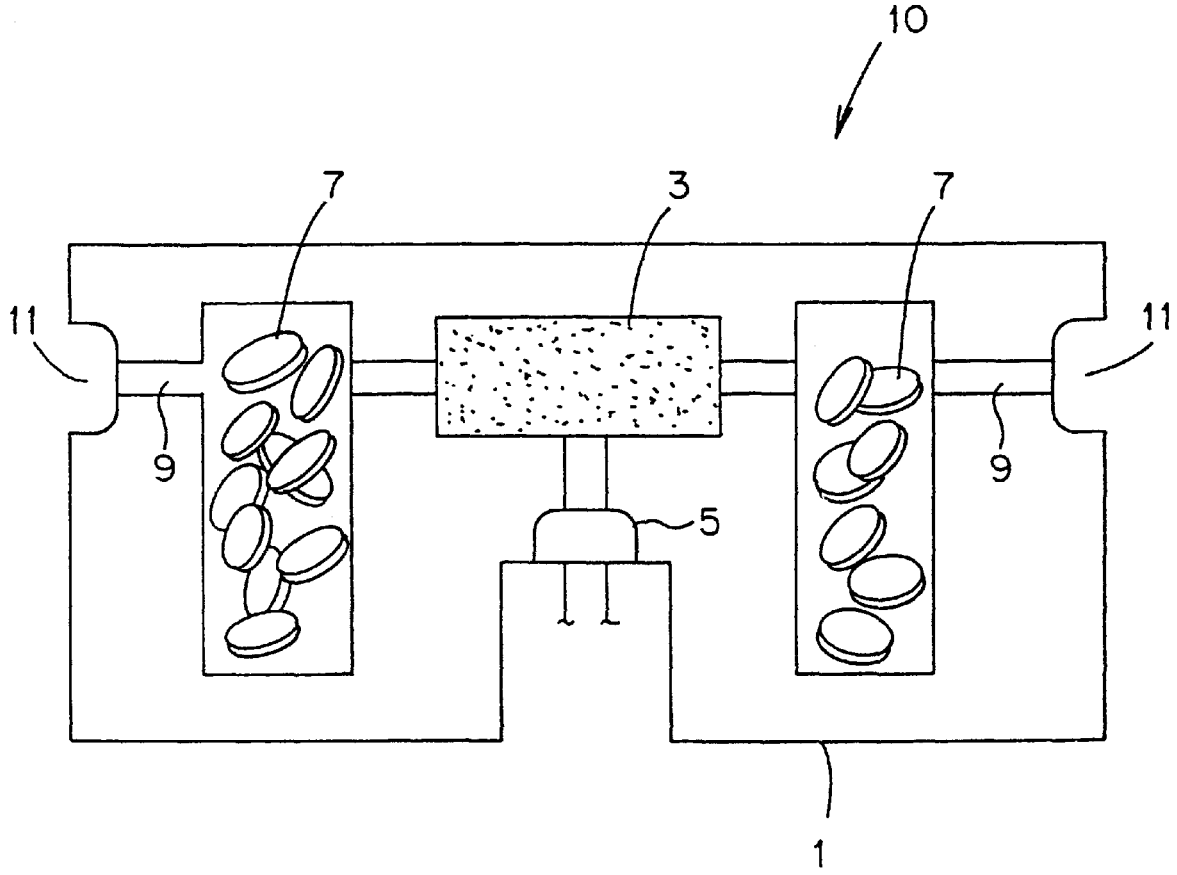
10
7
3
7
11
11
9
9
5
1

GAS GENERATING COMPOSITION WITH EXPLODED ALUMINUM POWDER

TECHNICAL FIELD

The present invention is directed to a gas generating composition, device and method of use and, in particular, to a gas-generating composition including an aluminum powder made by electro-explosive techniques, the aluminum powder increasing the burning rate and decreasing the pressure exponent during combustion of the gas-generating composition.

BACKGROUND ART

The use of ammonium nitrate (AN)—based gas generating compositions are well known, particularly for use in inflating devices such as air bag inflators. One of the problems with AN-containing compositions is the existence of a melt zone at the burning surface during the combustion process. This melt zone is positioned between the unburned AN material and the flame front. Melting of the AN at the flame front interface prior to combustion adversely affects the combustion of the overall composition, i.e., it lowers the burning rate of the gas-generating composition, since the melting and associated melt phase reactions are endothermic in nature. AN-based mixtures also exhibit a higher than ideal pressure exponent, particularly at low pressures. Generally, it is desired to have pressure exponents in the range of about 0.4 to 0.6. Pressure exponents above 1 can cause uncontrolled burning and over pressurization in choked motor designs. AN-based mixtures generally operate satisfactorily at high pressures. However, at lower pressures, AN-based mixtures have a tendency to extinguish themselves prior to complete combustion especially under regressive pressure conditions. With extinguishment, a large residue of uncombusted material remains, thereby adversely affecting the yield and economy of AN-based mixtures.

A prior art solution to the problems noted above (i.e. low burning rate and high exponent) with respect to AN-based compositions is the use of catalysts such as chromium or nickel salts. While these catalysts may effectively increase the burning rate, they produce toxic exhaust products that are generally not found acceptable in automotive air bag applications.

Consequently, a need has developed to provide improved gas generating compositions using AN or similar oxidizers which burn effectively at low pressures, e.g., have a desirable pressure exponent, and have a high burning rate. The present invention solves this need by using these types of compositions with an aluminum powder made by electro-explosive techniques, hereinafter "exploded aluminum powder". Using the exploded aluminum powder unexpectedly both increases the burning rate and lowers the pressure exponent for AN-based compositions and compositions similar thereto.

In the prior art, aluminum powder has been used as a fuel in gas generating compositions. Reissue Patent No. 25,692 to Cook et al. relates to an improved slurry explosive composition and, more particularly, to an explosive composition comprising ammonium nitrate, a heat producing metal such as aluminum, and water.

U.S. Pat. No. 2,589,532 to Byers discloses an explosive composition and, more particularly, but not exclusively, relates to alkali nitrate compositions in which ammonium nitrate is the predominating explosive ingredient. The Byers patent involves the discovery that when an atomized metal, aluminum, in the lower micron sizes is used in explosives, and more particularly in nitrate explosives, either with the metal particles as nuclei for the nitrate crystals, or as an exterior coating for the same, or are otherwise then mixed with the nitrate, there results an explosive which may be detonated by an ordinary no. 6 commercial blasting cap and one which shows good propagation characteristics.

U.S. Pat. No. 3,580,753 to Griffith discloses explosive mixtures based on trimethylolethane trinitrate and an inorganic nitrate, having a high rate of detonation and good sensitivity due to the incorporation of aluminum particles in the explosive.

None of the prior art discussed above teaches or suggests the use of exploded aluminum powder as part of a gas generating composition nor the unexpected benefits of increased burning rates and lowered pressure exponents.

SUMMARY OF THE INVENTION

Accordingly, a first object of the invention is an improved gas generating composition, device and method of use.

Another object of the present invention is an improved AN or strontium nitrate-based oxidizer mixture as a gas generating composition.

A still further object of the present invention is a method of using the inventive gas generating composition in inflating devices, particularly in air bag inflators.

Another object of the invention is a gas generating composition having a pressure exponent such that it burns effectively at low pressures and has a high burning rate.

Yet another object of the invention is a gas generating composition having a flame temperature below about 2300° K and having an ideal pressure exponent and high burning rate.

Other objects and advantages of the present invention will become apparent as a description thereof proceeds.

In satisfaction of the foregoing objects and advantages, the present invention is an improvement in gas generating compositions having conventional gas generating components. Typical of these compositions are propellants which include oxidizers, deflagrative additives, and fuels/binders. Examples of oxidizers include ammonium, alkaline earth metal and alkali metal nitrates, perchlorates and carbonates as well as scavenged combinations of the above such as ammonium perchlorate/potassium nitrate or ammonium perchlorate/lithium carbonate. "Scavenged" refers to the use of alkaline earth or alkaline metal nitrates and/or carbonates in combination with AP, where the alkaline earth or alkaline metal reacts with a stoichiometric level of chlorine from the AP to prevent the formation of free HCl in the exhaust products.

The deflagrative additives include guanidine derivatives such as mono-, di-, and tri-aminoguanidine nitrate, guanidine nitrate, nitroguanidine, tetrazole derivatives such as 5-aminotetrazole, and nitramines such as RDX and HMX.

Fuels/binders include cellulosic types such cellulose acetate, cellulose acetate butyrate, cellulose acetate propionate, etc., polyvinylchloride, water soluble resins such as polyvinyl alcohol, hydroxyl- and carboxyl- terminated polybutadienes, other polyesters, polyethers, thermal plastic block copolymers, azide-substituted polymers such as glycidyl azide polymer (GAP), and hydrocarbon waxes and various plasticizers.

In another embodiment in the invention, the gas generating composition should have a flame temperature near or below about 2,300° K. In yet further embodiment, gas generating compositions can have flame temperatures above this target. In this instance, it may be necessary to increase the amount of oxidizer as part of the gas composition in order to adjust the oxidizer/fuel ratio in the desired range. According to the invention, an effective amount of exploded aluminum powder is added to the gas generating composition to increase its burning rate and lower its pressure exponent. The gas generating composition preferably contains ammonium nitrate or strontium nitrate as an oxidizing component thereof. The aluminum powder, in one embodiment, ranges between about 2 to 20 weight percent of the composition as the effective amount. More preferably, the effective amount ranges between 5–15% and, even more preferably, 11–13%.

A preferred composition comprises a solid solution having ammonium nitrate, at least one of guanidine nitrate and aminoguanidine nitrate, a minor amount of polyvinyl alcohol and at least one of potassium nitrate and potassium perchlorate. A preferred embodiment of this composition is about 60% ammonium nitrate, about 30% quanidine nitrate, up to about 5% polyvinyl alcohol, and up to about 5 to 10% potassium nitrate or up to about 20% potassium perchlorate.

The invention also includes the method of inflating an inflating device by combusting the inventive gas generating composition.

Also disclosed is an inflating device using the inventive gas generating composition. The inflating device is, preferably, an air bag inflator.

The inventive composition can be in the form of one of a powder, granules, a pressed charge, an extruded charge, or any other known form for these types of explosive mixtures.

Using the exploded aluminum powder results in an increased burning rate, a lowered pressure exponent and a negligible effect on the overall combustion gases of the gas generating composition. The exploded aluminum powder exotherms without substantially reacting with an oxidizer of the gas generating composition. Consequently, the oxygen to fuel ratio associated with the composition is not adversely affected.

BRIEF DESCRIPTION OF DRAWINGS

Reference is now made to the sole FIGURE of the application which illustrates in schematic form an inflator utilizing the inventive gas generating composition.

DESCRIPTION OF THE PREFERRED EMBODIMENTS

The inventive gas generating composition provides significant improvements over known prior art compositions in terms of burning rate and pressure exponent. These improvements are achieved through the use of exploded aluminum powder as an additive to gas generating compositions particularly those having alkali metal or alkaline earth metal nitrates, perchlorates, carbonates as well as other known additives, binders and the like. In one embodiment, the compositions generally have a flame temperature less than 2300° K. The exploded aluminum powder, with its unique properties, decreases the pressure exponent of the composition while effectively increasing its burning rate.

Exploded aluminum powder is produced by a process that involves electro-explosion of aluminum wire under specific atmospheric conditions. The process produces vary small particle sizes in the range of 0.01 to 0.1 microns. These types of powders are produced by the Argonide Corporation.

Despite much study on the mechanisms and process iterations involved with exploded aluminum powder, the chemistry of the exploded aluminum powder composition and reactivity are not well understood.

Some of the unique physical and chemical properties of exploded aluminum powder are not being pyrophoric at room temperatures but being pyrophoric at temperatures of approximately 400° C. In inert atmosphere or air, pure exploded aluminum powder exotherms at about 300° to 400° C. at a rate of about 400 calories per gram. Exploded aluminum powder also reacts with nitrogen at 40 atmospheres pressure and room temperature to form aluminum nitride. In contrast, standard aluminum powder does not react with nitrogen until much high temperatures are reached.

Exploded aluminum powder also reacts with water at relatively low temperatures of 80–92° C. to form aluminum oxides, aluminum nitride and hydrogen. The reaction proceeds at temperatures of about 3200° K. Similarly, exploded aluminum powder reacts with hydrazine to form aluminum nitride and hydrogen.

Exploded aluminum powder is less reactive than standard grades of aluminum in air atmosphere at lower temperatures. The reactivity of exploded aluminum powder jumps sharply at temperatures above 300–400° C.

Exploded aluminum powder combusts more rapidly than normal aluminum powder and increases the burning rate of mixtures oxidized with ammonium perchlorate, potassium perchlorate or various nitrate salts.

Exploded aluminum powder-containing pyrotechnic mixtures burn completely at −70° C. In contrast, similar mixtures with standard aluminum powders would not combust, noting that most standard aluminized propellants can sustain combustion at −70° C. Similar results, i.e., a complete burn, were obtained where mixtures were placed in contact with a massive metal heat-sink. Exploded aluminum powder mixtures burn completely under these conditions while substantial residue of uncombusted material remained in the standard aluminum mix.

The exploded aluminum powder also has a natural or native aluminum oxide coating on its surface. This coating begins to melt at approximately 2300° K. As will be described hereinafter, in one embodiment, it is believed that gas generating compositions that have flame temperatures near or below approximately 2300° K will be ideally suited to have exploded aluminum powder as a combustion modifying additive therein.

When combining the exploded aluminum powder with a gas generating composition, it is believed that the burning rate is increased as a result of the exothermic nature of the powder at around 400° C. While not exactly understood, it is believed that the exploded aluminum powder has a strained crystal structure which undergoes an exothermic crystalline rearrangement at the above-stated temperature. This exothermic reaction contributes heat to the interface between the flame and the melt zone adjacent the unburned gas generating composition. As stated above, some gas generating compositions, particularly AN-based compositions, have an endothermic melt layer in the combustion zone which is positioned between the flame front and the uncombusted mixture. This melt layer decomposition is a rate limiting step affecting (slowing) the composition's burning rate. By adding the exploded aluminum powder to the gas generating composition, additional heat is contributed to the flame front-melt zone interface, thereby increasing the burning rate of the composition.

In one embodiment, the gas generating composition should have a flame temperature near or below about 2300°

K as stated above. If the composition's flame temperature is substantially above 2300° K, the native aluminum oxide on the surface of the exploded aluminum powder would tend to melt, thereby exposing the aluminum underneath. With the aluminum oxide removed, the aluminum could then combust with the oxidizer in the gas generating composition. The combustion between the aluminum and the oxidizer would affect the desired oxygen to fuel ratio of these kind of compositions, typically 0.92 to 0.98. The oxygen to fuel ratio is held slightly fuel rich to minimize formation of nitrogen oxides.

As stated above, the exothermic behavior associated with the exploded aluminum powder is not found in traditional aluminum powders. This is the reason that traditional aluminum powders have not been able to increase the burning rate of AN-based mixtures and mixtures similar thereto.

At flame temperatures below approximately 2300° K, it is also believed that the exploded aluminum powder does not react with the oxidizer of the gas generating composition. Rather, it is merely ejected from the flame front as a condensed species where it can be easily trapped or filtered. Since aluminum is typically a nontoxic material, its ejection from the flame front does not raise any safety or environmental concerns in the event that small amounts exit the device.

A significant advantage that exploded aluminum powder has as a ballistic modifier in the preferred composition(s) is that it exotherms without reacting with the oxidizer of the gas generating composition it is combined with.

With the inventive gas generating composition(s) containing the exploded aluminum powder, the same pressures as prior art mixtures are attained but with less mixture, since a better burning rate is achieved. The exploded aluminum powder does not combine with the oxidizer of the composition but merely functions as a ballistic modifier to increase the burning rate and lower the pressure exponent.

Typical of these compositions are propellants which include oxidizers, deflagrative additives, and fuels/binders. Examples of oxidizers include ammonium, alkaline earth metal and alkali metal nitrates, perchlorates and carbonates as well as scavenged combinations of the above such as ammonium perchlorate/potassium nitrate or ammonium perchlorate/lithium carbonate.

The deflagrative additives include guanidine derivatives such as mono-, di-, and tri-aminoguanidine nitrate, guanidine nitrate, nitroguanidine, tetrazole derivatives such as 5-aminotetrazole, and nitramines such as RDX and HMX.

Fuels/binders include cellulosic types such cellulose acetate, cellulose acetate butyrate, cellulose acetate propionate, etc., polyvinylchloride, water soluble resins such as polyvinyl alcohol, hydroxyl- and carboxyl- terminated polybutadines, hydroxyl and carboxyl-terminated polyesters and polyethers, thermoplastic block copolymers, azide-substituted polymers such as glycidyl azide polymer (GAP), and hydrocarbon waxes and various plasticizers.

In another embodiment in the invention, the gas generating composition should have a flame temperature near or below about 2,300° K. In yet further embodiment, gas generating compositions can have flame temperatures above this target. In this instance, it may be necessary to increase the amount of oxidizer as part of the gas composition in order to adjust the oxidizer/fuel ratio in the desired range. The use of the exploded aluminum powder is particularly suited for AN-based or strontium nitrate (SN)-based oxidized mixtures due to their naturally low deflagration rates in gas generant formulations. More preferably, it is preferred for use with AN-based mixtures. These mixtures typically have an endothermic melt zone which lowers the burning rate.

Most preferably, the exploded aluminum powder is used in the compositions disclosed in co-pending patent ampliation Ser. Nos. 08/663,009, 08/414,470, 08/508,350, 08/663,012, 08/708,195 and 08/720,454, assigned to the instant assignee, herein incorporated in their entirety by reference. Other gas generating compositions that may have utility with the exploded aluminum powder are those when the flame temperature is low enough to prevent combustion of the exploded aluminum powder to aluminum oxide.

The mixture of the exploded aluminum powder and the gas generating composition may be utilized in the form of a powder, granule, pressed charge or any other known form for explosive and gas generating compositions.

The sole FIGURE shows an exemplary use of the inventive gas generating composition as part of an air bag inflator. The inflator, designated by reference numeral 10, has a housing 1, a primary ignition agent 3 and an ignitor 5. The ignitor 5 ignites the primary ignition agent 3 which then subsequently ignites the inventive gas generating composition 7. Gases from the gas generating composition travel through the passageway 9 and are expelled from the outlets 11 for inflation of an air bag. Since these devices as well as other inflators are well known in the art, a further description thereof is not deemed necessary for understanding of the invention. It should be understood that any type of inflating device can use the inventive gas generating composition and the depiction of the air bag inflator is only exemplary.

It is believed that the exploded aluminum powder can be used at a weight percentage ranging from 2 to 20% of the overall gas generating composition. Preferably, the exploded aluminum powder ranges from 5 to 15 percent of the total mixture and more preferably 11 to 13%.

To demonstrate the effectiveness of the exploded aluminum powder when used as a ballistic modifier, comparisons were made using an AN-based mixture alone, and an AN-based mixture with 12% by weight of the exploded aluminum powder and an AN-based mixture using a conventional aluminum powder. The following Table shows the comparative results. COMP A in the table represents the baseline AN-based mixture, i.e., 60% AN, 30% GN, 5% KN and 5% PVA. COMP B is the baseline mixture, COMP A, with 12% of the exploded aluminum powder. COMP C is the baseline composition, i.e., COMP A, with 12% conventional aluminum powder.

Comparing the burning rate values, significant increases in burning rate are achieved when using the mixture containing the exploded aluminum powder. For example, at 4000 psi, the baseline COMP A had a burning rate of 0.76 ips whereas the exploded aluminum powder containing composition had almost a two fold increase in the burning rate. Moreover, the mere use of a conventional aerospace grade aluminum powder did not result in an increase in the burning rate. In fact, the burning rate is lower when using a conventional aluminum powder, i.e., 0.64 ips vs. 0.76 ips for COMP A.

The pressure exponent associated with exploded aluminum is also lower. For COMP A, at 1–2000 psi, the pressure exponent is 1.12. In contrast, the exploded aluminum powder-containing composition has a pressure exponent of 0.64. Reductions are also seen at the higher pressure values.

Finally, in conjunction with the comparisons set forth in the Table, effluent gas analysis was done in conjunction with the ballistic testing resulting in the value shown in the Table.

Low levels of CO were detected when using the exploded aluminum powder. These low levels indicate that little or none of the exploded aluminum powder reacted with available oxygen. If higher than normal levels of CO were detected, this would mean that the exploded aluminum powder reacted with the oxidizer of the gas generating composition to make it even more fuel rich than the target oxygen fuel ratio of 0.92 to 0.98. By being more fuel rich, more CO would be generated. The low and normal levels of CO means that the combustion of the gas generating composition was close to stoichiometric conditions and the exploded aluminum powder did not react with the oxidizer of the gas generating composition.

TABLE

| Mix # | COMP A | COMP B | COMP C |
|---|---|---|---|
| Mix Variable | baseline AN/GN/KN/PV | 12% exploded AL powder | 12% conv. AL powder |
| Composition, Ingredients Weight | AN/GN/KN/PV 60/30/5/5 | COMP A + exploded AL powder 100/12 | COMP A + Conv. AL powder 100/12 |
| Thermochemical: | | | |
| O/F ratio | 0.94 | same as A | |
| Temperature, K. | 2142 | (assumes no | |
| Gas, moles/100 gms | 4.18 | AL reaction) | |
| Density, gms/cc | 1.514 | | |
| Condensed Products, moles | .025 | .396 + .025 | |
| Condensed Species, % | $K_2CO_3$/3.46 | Al/10.7 + $K_2CO_3$/3.46 | |
| Hazards: | | | |
| Impact, kg-cm | 295 | 295 | |
| Friction, psi @ drop angle | >1800/90 | 500/90 | |
| Static, J/500 Volts | >6 | >6 | |
| Autoignition, ° C. | | | |
| DSC: | | | |
| melting point, ° C. | 121–123 | 115–127 | |
| exotherm onset, C | 242 | 259 | |
| heat of reaction, J/gm | | | |
| Burning Rate, ips @ pressure | | | |
| 1000 psi | .18 | .51 | .16 |
| 2000 psi | .37 | .79 | .30 |
| 4000 psi | .76 | 1.46 | .64 |
| n(1–2K)(2–4K) | 1.12/.96 | .64/.89 | .91/1.09 |

TABLE-continued

| Mix # | COMP A | COMP B | COMP C |
|---|---|---|---|
| Pellet properties: | | | |
| strength/dia., psi/in. | .520/5405 | .522/6977 | |
| 200 cycles | .528/7862 | .522/8425 | |
| 17 day/107C | .528/5530 | .525/7492 | |

*Aerospace grade 5 micron AL powder (MDX-65 grade).

The Table above clearly shows that the exploded aluminum powder is vastly superior to the conventional aluminum powder as a ballistics modifier and, quite unexpectedly, results in not only in an increase in the burning rate but a lowered pressure exponent.

As such, as invention has been disclosed in terms of preferred embodiments thereof which fulfill each and every one of the objects of the present invention as set forth above and provides a new and improved gas generating composition, device and method of use.

Various changes, modifications and alterations from the teachings of the present invention can be made without altering its intended scope. Accordingly, the invention is only to be limited by the terms of the appended claims.

What is claimed is:

1. A gas generating composition comprising a solid solution comprising ammonium nitrate, at least one of guanidine nitrate and aminoguanidine nitrate, a minor amount of polyvinyl alcohol and at least one of potassium nitrate and potassium perchlorate, the gas generating composition further comprising an exploded aluminum powder in an effective amount to increase a burning rate and lower a pressure exponent of the gas generating composition.

2. The composition of claim 1 comprising about 60% ammonium nitrate, about 30% guanidine nitrate, about 5% polyvinyl alcohol and about 5% potassium nitrate.

3. The composition of claim 1 wherein the exploded aluminum powder ranges between about 2 and 20 weight percent of the composition.

4. The composition of claim 3 wherein the exploded aluminum powder ranges between about 10 and 15 weight percent.

5. The composition of claim 2 wherein the exploded aluminum powder ranges between about 2 and 20 weight percent of the composition.

6. The composition of claim 5 wherein the exploded aluminum powder ranges between about 10 and 15 weight percent.

7. The composition of claim 6 wherein the effective amount of the exploded aluminum powder is about 12% by weight of the composition.

* * * * *